United States Patent [19]

Wessels

[11] 4,429,488

[45] Feb. 7, 1984

[54] ELECTRIC VEHICLE WITH MAGNETIC ATTRACTION TO TRACKWAY

[76] Inventor: John A. Wessels, 125 Campanita CT., Monterey Park, Calif. 91754

[21] Appl. No.: 310,807

[22] Filed: Oct. 13, 1981

[51] Int. Cl.[3] ..... A63H 18/12

[52] U.S. Cl. ..... 46/257; 104/305; 310/40 MM

[58] Field of Search ..... 46/236, 238, 239, 240, 46/257, 259; 310/40 MM; 273/86 B; 104/305, 60; 105/77

[56] References Cited

U.S. PATENT DOCUMENTS

| | | | |
|---|---|---|---|
| 2,325,915 | 8/1943 | Naul | 310/40 MM |
| 3,086,319 | 4/1963 | Frisbie et al. | 46/259 |
| 3,243,917 | 4/1966 | Giammarino et al. | 46/257 |
| 3,406,481 | 10/1968 | Tachi | 46/226 X |
| 3,964,206 | 6/1976 | Bernhard | 46/251 |
| 4,031,661 | 6/1977 | Bernhard | 46/259 X |
| 4,127,785 | 11/1978 | Noguchi | 310/40 MM |

FOREIGN PATENT DOCUMENTS

| | | | |
|---|---|---|---|
| 677101 | 12/1963 | Canada | 310/40 MM |

*Primary Examiner*—F. Barry Shay

*Attorney, Agent, or Firm*—Robert K. Youtie

[57] ABSTRACT

A model vehicle, say of the road racing type, movable along a track having magnetically permeable rails, the vehicle including an electric motor wherein the field magnets are mounted in a non-magnetic casing or yoke to permit maximum magnetic coupling of the field magnets with the rails to exert a downward force on the vehicle toward the track.

2 Claims, 6 Drawing Figures

ELECTRIC VEHICLE WITH MAGNETIC ATTRACTION TO TRACKWAY

BACKGROUND OF THE INVENTION

As is well known to those versed in the art, model vehicles such as road racing cars and the like, tend to slip, skid or lose traction with the road surface, sometimes spinning out at greatly reduced or inoperative propulsive force. While many proposed means have attempted to minimize or obviate such loss of control and speed, satisfactory means for this purpose has not been achieved without increased complexity, weight and cost, and consequent reduction in reliability and speed.

SUMMARY OF THE INVENTION

It is an important object of the present invention to provide a model vehicle, say of the road racing type, which has greatly improved traction and handling characteristics, resulting in more precise control and speed, both on straightaway and curved track.

It is a more particular object of the present invention to provide a road racing vehicle which utilizes magnetic attraction between the drive motor of the vehicle and the roadway or track to achieve increased traction and speed, and improved handling.

It is still a further object of the present invention to provide a model vehicle having the advantageous characteristics set forth in the preceeding paragraphs, which achieves such improvements at little or no increase in cost or sacrifice in quality or function.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
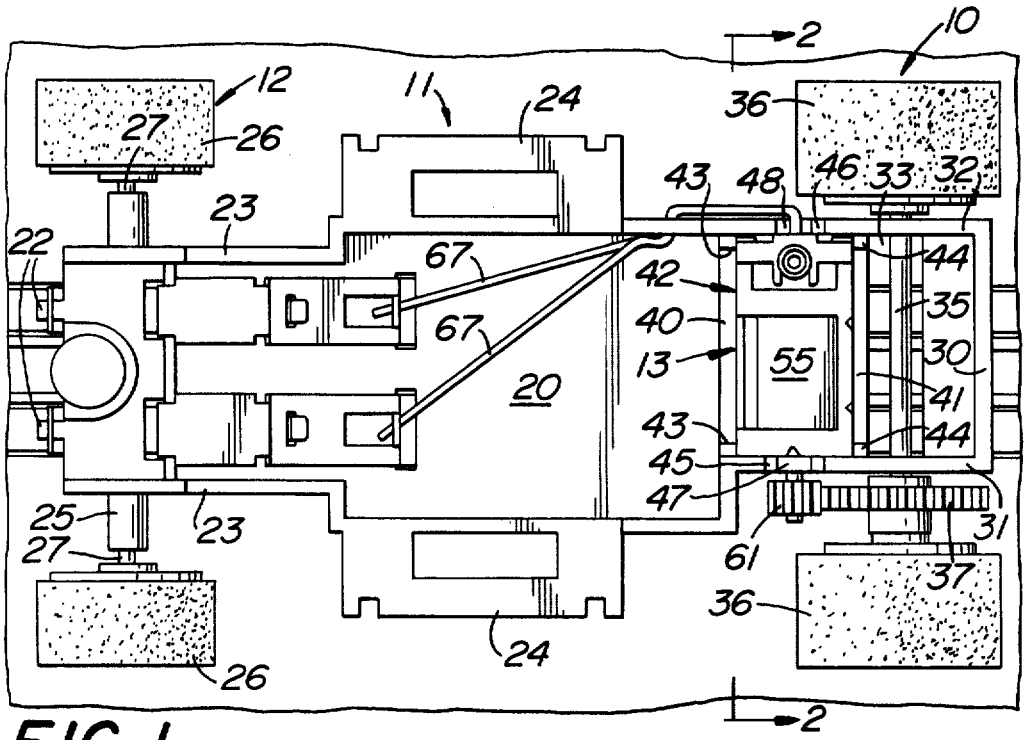
FIG. 1 is a top plan view of a model roadracing vehicle of the present invention without the covering body or simulated sheet metal.

Referring now more particularly to the drawings, and specifically to FIG. 1 thereof, a model road racing car is shown therein, absent a cover or simulated sheet metal body, to better illustrate the structure and operation of the vehicle.

The vehicle 10 is illustrated as including a body or chassis 11 having ground engageable running gear 12, and a propulsion system 13.

Figure 2:
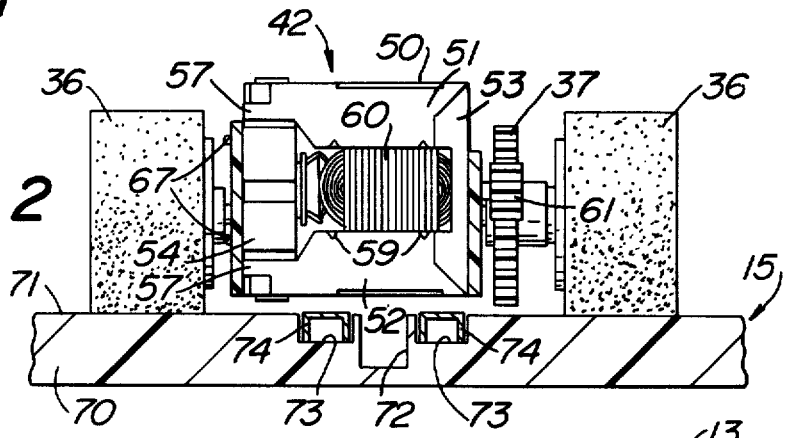
FIG. 2 is a transverse sectional elevational view taken generally along the line 2—2 of FIG. 1.
Figure 5:
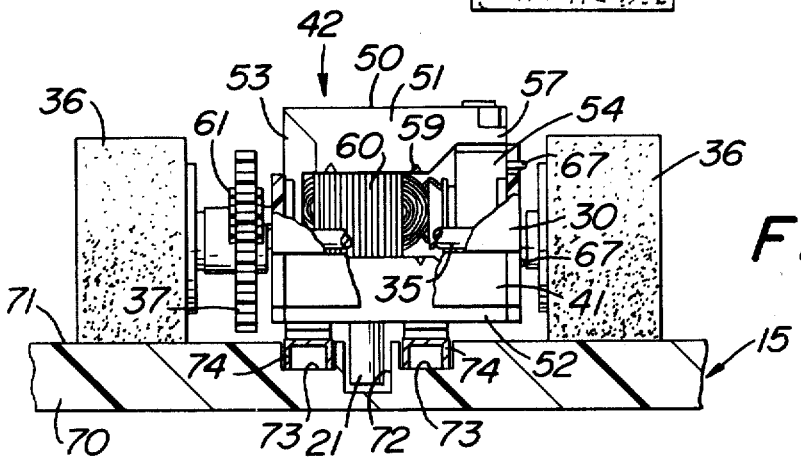
FIG. 5 is a rear elevational view partly broken away, and illustrating in section a roadway or track in operative association with the vehicle.
Figure 6:
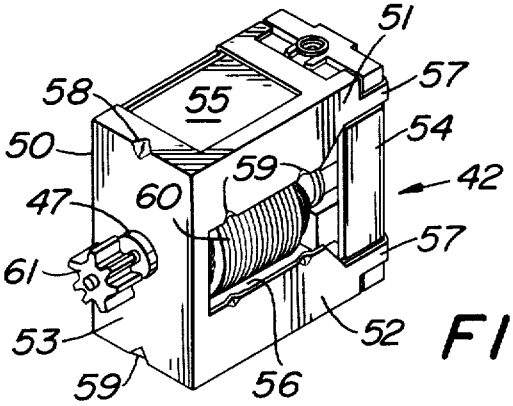
FIG. 6 is a top perspective view showing a drive motor of the present invention apart from the vehicle.

A roadway or track is generally designated 15, being of substantially constant cross section throughout its length, and being shown in cross section in FIGS. 2 and 5.

Figure 3:
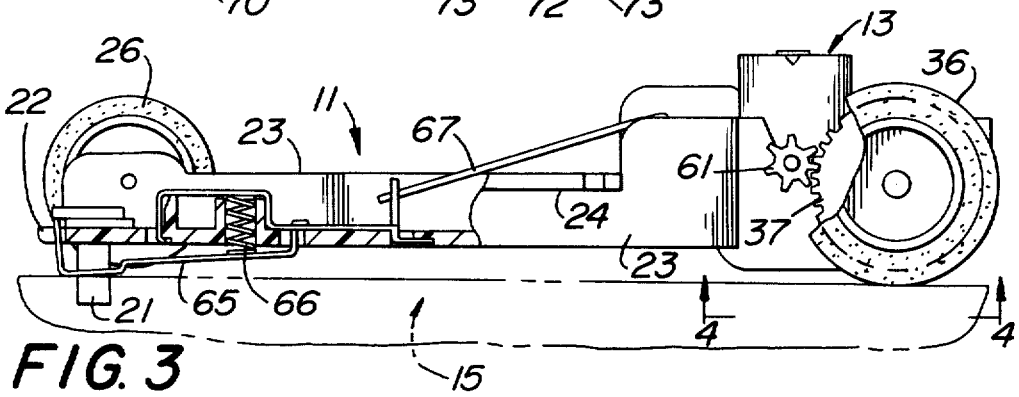
FIG. 3 is a longitudinal side elevational view taken from one side of FIG. 1.
Figure 4:
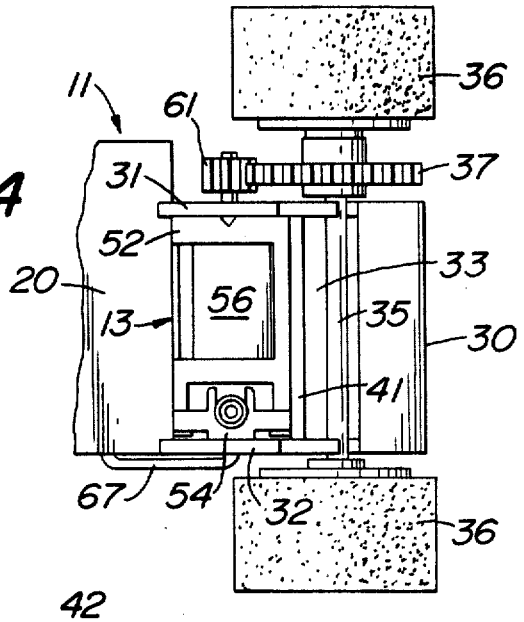
FIG. 4 is a partial bottom view taken generally along the line 4—4 of FIG. 3.

Referring now more specifically to the chassis or body 11, it may be integrally fabricated of plastic, as by injection molding, or otherwise fabricated of any suitable material, and may include a longitudinally extending, generally horizontal bottom wall 20 having at its forward end located laterally medially thereof a depending guide member or pin 21, best seen in FIGS. 3 and 5. On opposite sides of the guide pin 21, projecting forwardly from the chassis 11, generally in the plane of the chassis bottom wall 20 are a pair of lugs 22. Extending longitudinally along each side of the bottom wall 20, generally coextensive therewith are upstanding side walls 23; and, outstanding laterally from uppper regions of the side walls 23, medially between the forward and rearward ends of chassis 11 are retainer members or wings 24, suitably configured for retaining engagement with a sheet metal simulation or vehicle covering (not shown).

Projecting laterally outwardly from the forward region of each chassis side wall 23 are a pair of aligned journal tubes 25, and a pair of front wheels 26 are respectively journaled in the tubes 25 by axles 27.

A rear chassis wall 30 extends laterally between the rear ends of the chassis side walls 23. The rearward regions of chassis side wall 23, adjacent to opposite ends of rear chassis wall 30 are designated 31 and 32, respectively on the left and right sides of the chassis, and the chassis has its bottom wall 20 cutaway as at 33 between side wall portions 31 and 32 adjacent to and forward of the rear wall 30. The rear side wall portion 31 on the left side of the vehicle may be offset inwardly from the remainder of the side wall 23, while the rear side wall portion 32 may be a longitudinal extension of the adjacent region of the right side wall 23.

A rear axle 35 extends laterally between the chassis side wall rear portions 31 and 32, over a rearward region of the bottom wall opening 33, laterally outwardly through and beyond the rear side wall portions for journaling therein, and are provided on their outer ends with ground engageable wheels 36. Inboard of one wheel, say the left rear wheel 36, adjacent to and outward of the rear side wall region 31 may be a spur gear 37 keyed to the shaft 35.

At the forward side of the opening 33 and bounding the latter is a laterally extending wall or partition 40 upstanding from the bottom wall 20; and spaced rearwardly therefrom, over the opening 33 and forwardly of the rear axle 35 is a laterally extending partition 41. The space bounded within the rear chassis side wall portions 31 and 32, and the front and rear partitions 40 and 41 serves to conformably receive a motor 42 of the propulsion system 13. At opposite ends of the front partition 40 there are provided vertically extending, inwardly facing positioning members or ribs 43; and similarly, there are provided vertically extending inwardly facing positioning members or ribs 44 at opposite ends of the rear partition 41. Spaced between the front and rear partitions 40 and 41, the rear side wall portions 31 and 32 are formed with upwardly facing receivers or notches 45 and 46.

The motor 42 is conformably received within the space bounded by the front and rear partitions 40 and 41, and the rear side wall portions 31 and 32, and is provided with end extensions or shaft journals, as at 47 and 48 respectively received and seated in notches 45 and 46. The journals 47 and 48 may be snap engaged into notches 45 and 46 for effective retention therein under even abusive conditions of use.

The motor 42 may advantageously be a direct current permanent magnet type including a casing or yoke 50 including upper and lower magnet receiving portions or holders 51 and 52. At one end, say the left hand end, the yoke may include an end wall 53 connecting together the upper and lower magnet receiving portions 51 and 52. The other end of yoke 50 may be provided with an end member or block 54.

The upper and lower magnet receiving portions or holders 51 and 52, and the yoke end 53 may all be integrally fabricated of non-magnetic material, such as sheet metal suitably cut and bent. The magnet holders 51 and 52 may be vertically aligned and spaced apart, having their upper and lower sides open, and respectively receiving therein vertically spaced, upper and lower permanent magnets 55 and 56. The yoke end member 54 is also of non-magnetic material, such as plastic and positively retained in its end closing relation by suitable tabs, such as 57. The permanent magnets may be suitably secured in position by appropriate indents, as at 58 and 59, or otherwise as desired.

A rotary armature 60 may be interposed between the permanent magnets 55 and 56, being journaled in opposite ends 53 and 54 of the yoke or casing 50 and provided on one end with a spur gear or pinion 61 in meshing engagement with the spur gear 37. On the other end of the armature 60 may be a commutator and appropriate journaling in the end member 54. The armature 60 may be essentially conventional; and, the motor 42 may be conventional except that the yoke or casing 50 is of non-magnetic material, so that magnetic flux from the magnets 55 and 56 is not constrained by or to the yoke.

While the motor 42 has been illustrated as arranged with its permanent magnets vertically spaced and one over the other, and the armature with its rotary axis extending laterally, it is appreciated that the motor may be arranged with its armature axis extending longitudinally and/or with the permanent magnets spaced horizontally rather than vertically.

Carried on the underside of the chassis bottom wall 20, in the forward region thereof, are a pair of pickup shoes 65 on opposite sides of the guide pin 21 and resiliently yieldably urged downwardly, as by suitable springs 66 into contacting engagement with nether parts of a roadway or track 15. The shoes 65 loosely receive and are constrained to limits of motion by the lugs or tangs 22. Conductors 67 extend in electrical connection from each pickup shoe 65 to the commutator brushes (not shown) of motor 42, in the conventional manner.

The track or roadway 15 may be conventional, including a bed 70 having an upper wheel supporting surface 71. Laterally medially of the track 15 there is provided a longitudinally extending, upwardly opening groove 72 for loosely receiving and constraining the guide pin 21 which depends to a level below that of the wheels 26 and 36. On oppposite sides of the guide pin receiving groove 72, the roadway or track 15 is formed with a pair of longitudinally extending, upwardly opening rail receiving grooves 73. Each groove 73 has permanently affixed therein a rail 74, which is electrically conductive and magnetically permeable, such as by fabrication of steel, and may be of channel-like or inverted U-shaped configuration with its webb exposed for contact with a respective pickup shoe 65. In this manner, electric power is conducted through the rails 74 to the shoes 65, and conductor 67 to the motor 42 for operating the latter. Motor operation rotates armature 60 and drive pinion 61 in meshing engagement with driven spur gear 37 to rotate drive wheels 36 in frictional engagement with track surface 71.

It will be apparent that the absence of magnetic material in the motor case 50 permits improved magnetic flux coupling between the motor magnets 55 and 56 and the magnetically permeable rails 74. In this manner the magnetic force between the motor magnets and rails serves to augment gravity and increase the force imparted by the chassis 11 through the wheels 26 and 36 to the track surface 71. This enhances driving wheel friction to permit greater wheel speed without slipping and improves control and handling, say on curves and in other conditions requiring more precise operation.

From the foregoing it is seen that the present invention provides a model vehicle construction which is extremely simple, durable throughout a long useful life, and fully accomplishes its intended objects at little or no cost.

Although the present invention has been described in some detail by way of illustration and example for purposes of clarity of understanding, it is understood that certain changes and modifications may be made within the spirit of the invention.

What is claimed is:

1. A model vehicle for movement along a track having a pair of magnetically permeable rails, said vehicle comprising a non-magnetic chassis, track-engageable running gear on said chassis, a motor carried by said chassis in driving relation with said running gear and positioned on said chassis for location above said rails when said running gear is engaging said track, said motor comprising a yoke, magnet holders in said yoke, an armature rotatable about a horizontal axis transverse to said rails and within said yoke between said magnet holders, and magnets in said holders for magnetically effecting rotation of said armature, said yoke and magnet holders being non-magnetic so that said motor is essentially non-magnetic except for said armature and magnets, whereby magnetic flux from said magnets is not constrained, for increased magnetic coupling of said magnets with said rails to increase force by said chassis toward the track.

2. A model vehicle according to claim 1, said magnets being arranged in vertically spaced relation and having generally vertical flux paths adapted to pass through said rails, the lower of said magnets being magnetically attracted to both rails without detracting from armature flux.

* * * * *